United States Patent [19]

Dee

[11] 4,165,055

[45] Aug. 21, 1979

[54] BOBBIN WITH SNAP RING

[75] Inventor: Rudolf Dee, Wuppertal, Fed. Rep. of Germany

[73] Assignee: Firma Hacoba Textilmaschinen GmbH & Co. KG, Wuppertal, Fed. Rep. of Germany

[21] Appl. No.: 857,747

[22] Filed: Dec. 5, 1977

[30] Foreign Application Priority Data

Dec. 13, 1976 [DE] Fed. Rep. of Germany ..... 2656326
Jan. 24, 1977 [DE] Fed. Rep. of Germany ..... 2702802

[51] Int. Cl.[2] ..... B65H 75/28
[52] U.S. Cl. ..... 242/125.2
[58] Field of Search ..... 242/125.1, 125.2, 125, 242/118.4, 118.41, 71.8, 137.1

[56] References Cited

U.S. PATENT DOCUMENTS 3,430,886 3/1969 Sweeney ..... 242/118.41 X
4,027,831 6/1977 Rottleb ..... 242/125.1

*Primary Examiner*—George F. Mautz
*Attorney, Agent, or Firm*—Karl F. Ross

[57] ABSTRACT

A bobbin on which a package of thread-form or strip-form material can be wound has at one or both ends a reflexive snap ring which is selectively displaceable between first and second positions with an over-center snap action. In the first position of the snap ring the end of the thread or other material to be wound on the bobbin is held fast in a slot at the boundary of a thread-receiving channel which extends circumferentially around the bobbin, while in the second position of the snap ring the channel is opened for access. The snap ring may be integral with the bobbin sleeve and the bobbin made of a synthetic-resin material. The snap ring can be used on bobbins which have a circumferential flange to retain the wound package and on bobbins without such a flange, in which case the snap ring is directly engageable with the end of the package.

8 Claims, 16 Drawing Figures

Fig.4
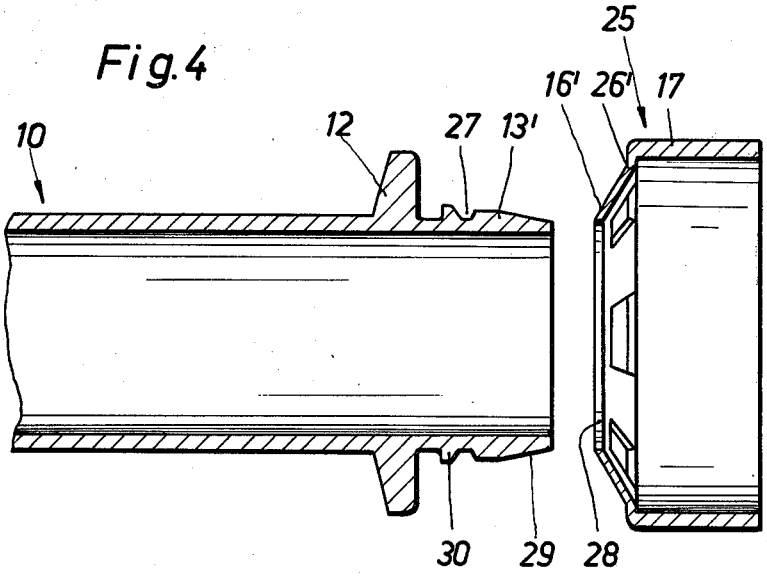
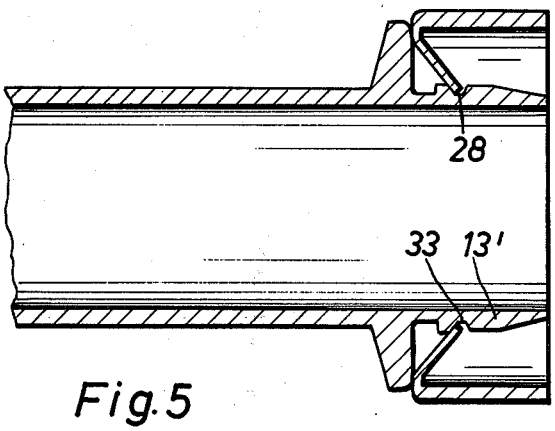
Fig.5

Fig. 15
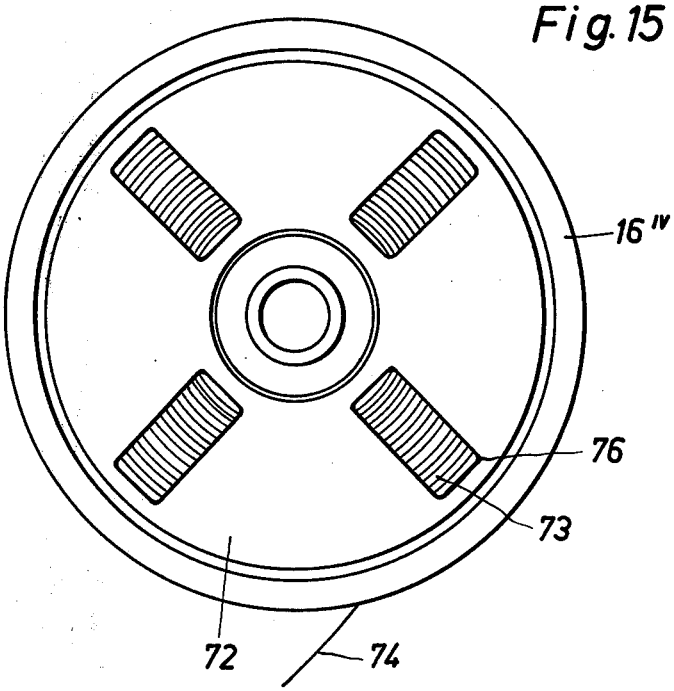
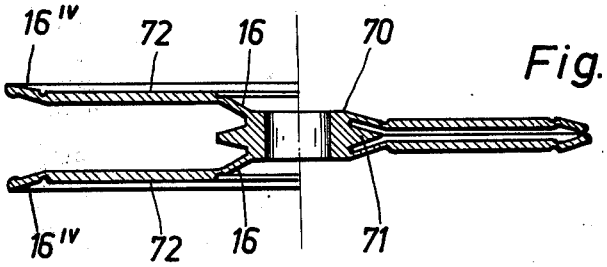
Fig. 16

BOBBIN WITH SNAP RING

FIELD OF THE INVENTION

This invention relates to bobbins for thread-form or strip-form material, such as yarn, filaments, wire, tapes and the like.

The bobbin comprises a sleeve portion, and means defining a circumferential channel to receive the end of a length of the material therein and comprising a channel-defining element on one side of the channel which is separable from or an integral part of the bobbin and which is arranged to narrow the channel at a boundary thereof to form a thread-clamping slot.

DESCRIPTION OF THE PRIOR ART

In one known bobbin of this general type as described in German open patent application No. DT-DS 26 03 133 a radially projecting, sleeve-like channel-defining element is connected to the one end of the bobbin by means of a connecting web which can be broken so that after breaking the web at this zone of weakness the channel-defining element can be pushed down over the end of the bobbin, which is provided with flexible ribs, until it abuts against an annular flange provided on the bobbin sleeve portion and in conjunction with which it defines the thread-receiving channel and the thread-clamping slot.

The channel-defining element which rests frictionally on the flexible ribs can to some extent be moved back from the annular flange in order to facilitate the insertion of the thread end into the clamping slot. In consequence however one cannot achieve a sufficient clamping force for the thread in the thread clamping slot. Moreover, the clamping slot cannot be held open without a permanent axial force being exerted on the channel-defining element. This makes the use and handling of this bobbin more difficult.

Another sleeve-like bobbin is known from German Gebrauchsmuster No. 70 17 074. In one end of this bobbin, which is provided with a flange, a sleeve-like channel-defining element which is T-shaped in longitudinal cross-section is fitted and clamped. This element is provided with resilient tongues which carry knobs which engage the flange of the bobbin and thus narrow the thread-receiving channel at this zone between the flange and the channel-defining element. The clamping and release of the thread is in this case associated with undesirable tension on the thread and with other difficulties, particularly if the thread end is wound fully around the circumference of the thread-receiving channel.

SUMMARY OF THE INVENTION

It is an object of the present invention to provide a bobbin of the type first mentioned above by means of which improved clamping and holding of the thread is possible, while providing a bobbin which is of simpler construction than those described above, which is easier to manufacture, and which above all is simple to handle.

This is achieved in accordance with the present invention by a bobbin for thread-form or strip-form material comprising a sleeve portion, and means defining a circumferential channel to receive the end of a length of material therein and comprising a channel-defining element on one side of the channel which is separable from or an integral part of the bobbin and which is arranged to narrow the channel at a boundary thereof to form a thread-clamping slot, in which the channel-defining element comprises a reflexive snap ring which is selectively displaceable between a first position and a second position by an over-center snap action, said first position enabling a thread to be held clamped in said slot and said second position being an open position enabling access to be gained to said channel.

By this means the beginning of a thread can be clamped without difficulty in the thread-receiving channel, even if the beginning of the thread vanishes wholly within the channel. In an equally simple manner the beginning of the thread can be withdrawn from the channel, even if the beginning of the thread should be lying completely covered in the channel, since the snap ring can be drawn back into its open position without effort.

The bobbin with its reflexive snap ring are preferably made in one piece as an integral unit, particularly of a thermoplastic material. In this way one can provide a bobbin of very simple structure and which is extremely easy to manufacture. However, the reflexive snap ring can alternatively be removably connected to the bobbin sleeve portion.

According to a preferred feature of the invention, the side of the thread-receiving channel which is opposite to and faces the snap ring is defined by a flange on the bobbin sleeve portion.

According to another preferred feature of the invention, the side of the thread-receiving channel which is opposite to and faces the snap ring can alternatively be formed by the edge of a wound package on the bobbin.

BRIEF DESCRIPTION OF THE DRAWING

In order that the various features and advantages of the bobbin of the present invention may be fully understood, a number of embodiments of bobbin in accordance with the invention will now be described by way of example and with reference to the accompanying drawing, in which:

FIGS. 4 and 5 are partial sectional views of a two-part bobbin with a separable snap ring, FIG. 4 showing the ring about to be placed on the end of the bobbin sleeve and FIG. 5 showing the ring in its clamping position;

DESCRIPTION OF THE PREFERRED EMBODIMENTS

Figure 1:
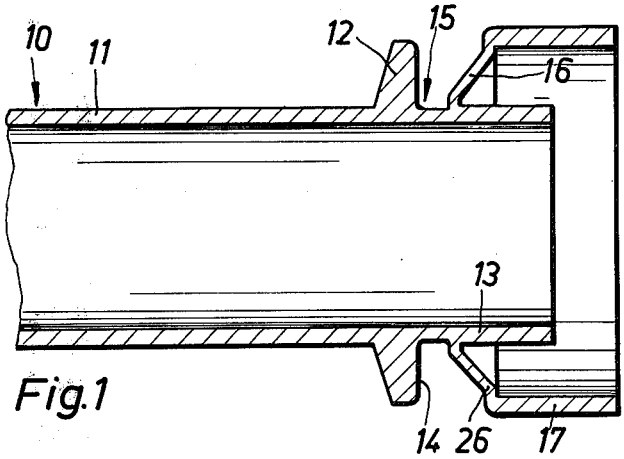
FIGS. 1 and 2 are partial sectional views through a first embodiment of bobbin having a snap ring which is shown in its open position in FIG. 1 and in its closed position in FIG. 2.
Figure 2:
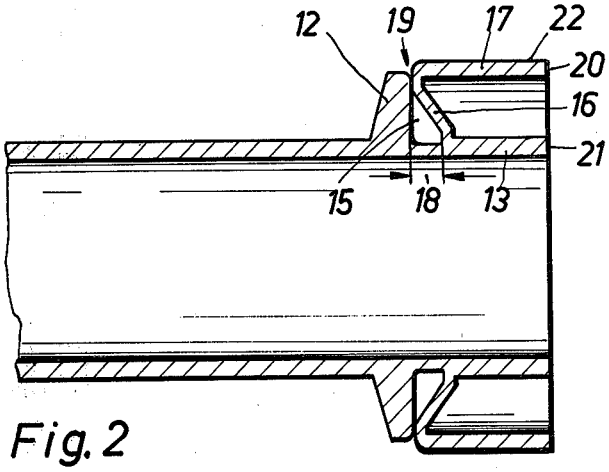

The bobbin 10 which is shown in FIGS. 1 and 2 comprises a flanged sleeve having a sleeve body 11 which is provided with a circumferential flange 12 at at least one end. The sleeve body 11 is extended axially out beyond the circumferential flange 12 to form a sleeve extension 13. On the axially outward side of the circumferential flange 12 there is a circumferential thread-receiving channel 15 with one side of the channel being defined by the end face 14 of the flange 12. The end or ends of the thread-form or strip-form material forming the wound package lie within this channel. A snap ring 16 is provided on the sleeve extension 13. The snap ring 16 is an annular web of material which is movable between two defined limit positions with an over-center snap action, one limit position being shown in FIG. 1, i.e. with the channel 15 open, and the other limit position being shown in FIG. 2, i.e. with the channel 15 closed. This movement of the snap ring between the limit positions is hereinafter referred to as a reflexing movement and the ring as a reflexive snap ring. The snap ring 16 is provided around its circumference 26 with an outer sleeve 17 which serves as a hand-grip and which lies coaxially with respect to the bobbin and the sleeve body 11. The various bobbin parts are formed integrally with one another and are preferably made of a thermoplastic material.

FIG. 2 shows the snap ring 16 in its clamping position close to the flange 12, in which position the ring 16 narrows or even closes the thread-receiving channel 15 at the outer rim of the flange 12. Because the snap ring 16 is connected to the sleeve extension 13 at a distance 18 from the flange 12 the thread-receiving channel 15 therefore has a large volume and is capable of taking yarn, for example, of considerable thickness. However, the channel 15 is reduced at its radially outward boundary in such a way that the snap ring 16 and the outer sleeve 17 carried by the snap ring either abuts against the flange 12 or leaves a small gap between it and the flange, the width of this gap being smaller than the thread diameter. In both cases a clamping zone 19 for the thread is formed which ensures that the thread is properly held in this zone with the loose thread end located in the channel 15. The axial ends 20, 21 of the outer sleeve 17 and of the sleeve extension 13 lie flush with one another when the snap ring 16 is in its thread-clamping position, so that a label can be stuck on the end of the bobbin formed by the two annular end faces 20 and 21. Naturally, it is alternatively or additionally possible to provide a label on, or to print upon, the outer peripheral surface 22 of the outer sleeve 17.

Figure 3:
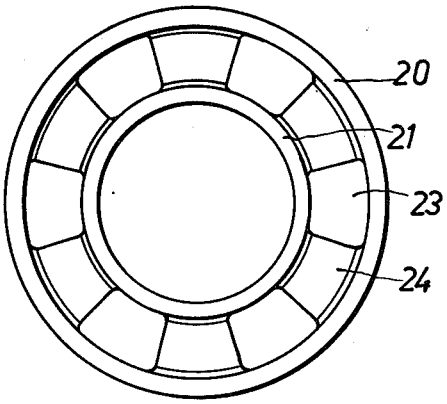
FIG. 3 is an end view of the bobbin shown in FIGS. 1 and 2.

As shown in FIG. 3, the snap ring 16 may be provided at spaced intervals around its circumference with holes 23 which are approximately trapezoidal in shape. The dimensions of these holes 23 are approximately equal to the dimensions of the snap ring sections 24 which remain between the holes, but the holes may have some other dimensions as appropriate to particular circumstances.

The bobbin 10 which is shown in FIG. 4 has a separable channel-defining portion 25 which, as in FIG. 1, consists of a reflexive snap ring 16' and an outer sleeve 17 at the outer circumference 26° of the ring. In this embodiment the sleeve extension 13' is provided with a circumferential groove 27 which is of a size suitable for receiving the radially inner edge 28 of the snap ring. As shown in FIG. 5, the sleeve extension 13' and the channel-defining portion 25 are pushed one on to or into the other so that the inner edge 28 of the snap ring is pushed first over a tapering guide surface 29 on the sleeve extension and upon further axial movement of the outer sleeve 17 in the direction towards the flange 12 is restrained by an annular collar 30 provided around the circumference of the sleeve extension 13' until the snap ring takes up the position shown in FIG. 5. In this embodiment different materials can be chosen for the parts 10 and 25, for example one can use a duroplast or polystyrene for the bobbin sleeve 10 and one can use for example a high-density polyethylene or polypropylene for the separable end piece 25.

Figure 6:
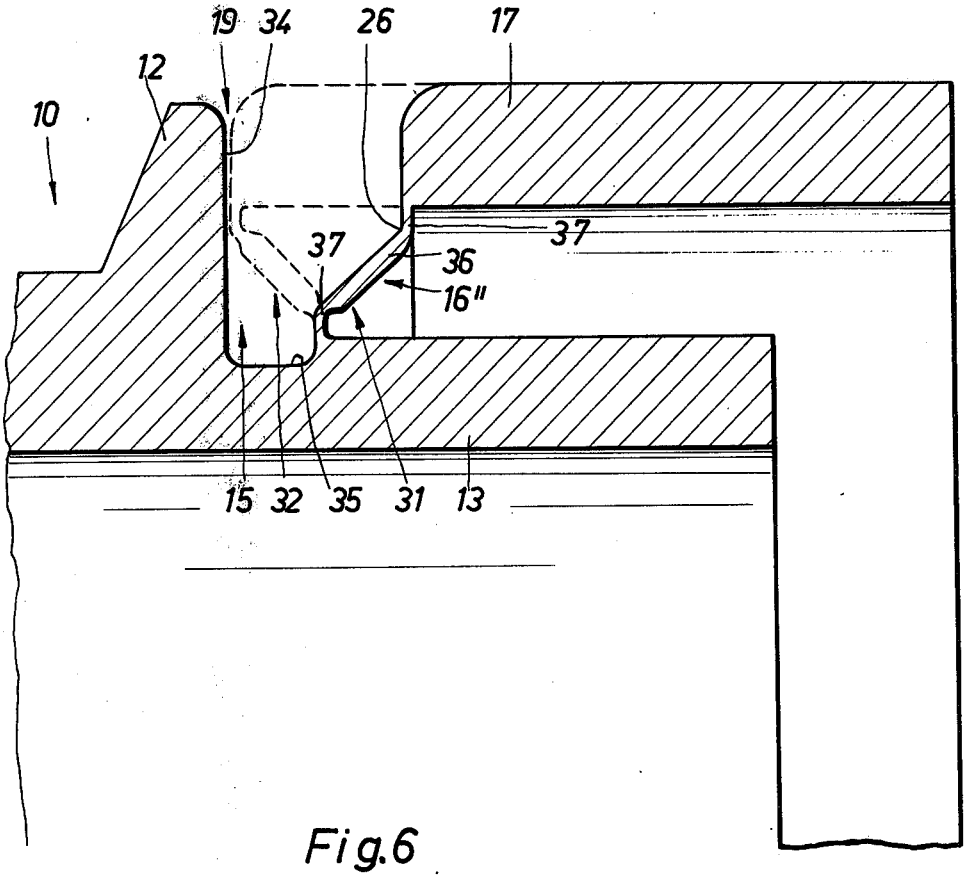
FIG. 6 is a view on an enlarged scale of the portion of a bobbin in the region of the thread-receiving channel.

FIG. 6 is provided in order to show clearly how the reflexive snap ring 16'' is inverted from its open position 31 in which it is spaced from the flange 12 to its thread-clamping position 32 where it is close to or in contact with the flange 12. To accomplish this, the outer sleeve 17 which is connected to the sleeve extension 13 by the snap ring 16'' is urged axially in the direction towards the bobbin 10. This displacement of the outer sleeve 17 sets up a resistance to displacement in the snap ring 16'' which reaches a maximum value when the ring is positioned approximately midway between the two positions indicated at 31 and 32. After this midpoint has been passed, the ring 16'' snaps into position 32 without any further force having to be applied to it, in the manner of an over-center spring. The outer sleeve and the snap ring are indicated by broken lines in this position. The snap ring 16'' has a central portion 36 which is comparatively stiff in comparison to the flexible hinges 37 by which it is connected both to the sleeve extension 13 and to the outer sleeve 17. Consequently, the deformation process takes place substantially at the flexible hinges 37 which are specifically designed to be able to survive a large number of flexing movements without suffering from fatigue stresses. The snap ring 16'' can alternatively be connected to the sleeve extension 13 by means of a plurality of bridging webs.

The outer sleeve 17 cannot revert from the clamping position 32 unintentionally, not even with the type of separable snap ring 16' shown in FIG. 4, because here for example the inner edge 28 of the snap ring abuts against the annular internal surface 33 of the groove 27 in the sleeve extension 13'.

The thread-receiving channel 15 is narrowed at the radially outward boundary sufficiently for a clamping zone 19 to be formed. The gap 34 between the outer sleeve 17 and the flange 12 is arranged to be smaller than the diameter of the thread which is to be taken up. After the beginning of a thread or a thread end has been located in the thread-receiving channel 15 with the thread crossing the clamping zone 19 it is held securely there, possibly leaving an extreme thread beginning or thread end in the clamping zone so that the thread can be withdrawn later from the thread-receiving channel without the outer sleeve 17 even havng to be pulled back into the withdrawn position which is illustrated. The invention is applicable not only to textile threads but also for example to metallic threads or wire.

Figure 7:
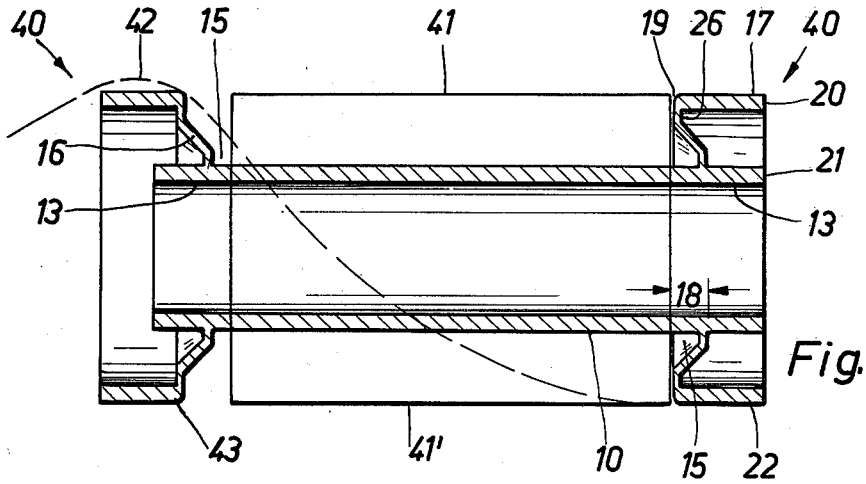
FIG. 7 is a sectional view through a bobbin having snap rings provided at both ends, these rings being able to reflex against the edge of the wound package.

FIG. 7 shows a bobbin sleeve 10 which has a thread retainer 40 at each end, the wound package 41 being located between the thread retainers. The bobbin sleeve 10 has the thread retainers 40 formed integrally with the sleeve extension 13, each of the thread retainers 40 consisting of a reflexive snap ring 16 and a sleeve-like hand-grip portion 17 at the outer margin 26 of the snap ring. The bobnin sleeve and thread retainers are preferably made of a thermoplastic material.

The right-hand portion of FIg. 7 shows the snap ring 16 in its clamping position adjacent to the wound package 41. In this position it defines with the package a thread-receiving channel 15 which is narrowed or closed at its radially outward boundary. In contrast, the left-hand portion of FIG. 7 shows the snap ring 16 in its open position where it is withdrawn from the package 41 and in which position the thread-receiving channel 15 is accessible without difficulty from the outside. In this latter position of the thread retainer 40 it is possible to achieve overhead withdrawal of the thread 42 from the package 41 without difficulty, even if the package has only a reduced diameter 41' for example. The deflection of the thread 42 by the edge 43 of the thread retainer is decidedly less in this position of the thread retainer than it would be in the thread-clamping position of the thread retainer 40 shown in the right-hand part of FIG. 7.

Figure 8:
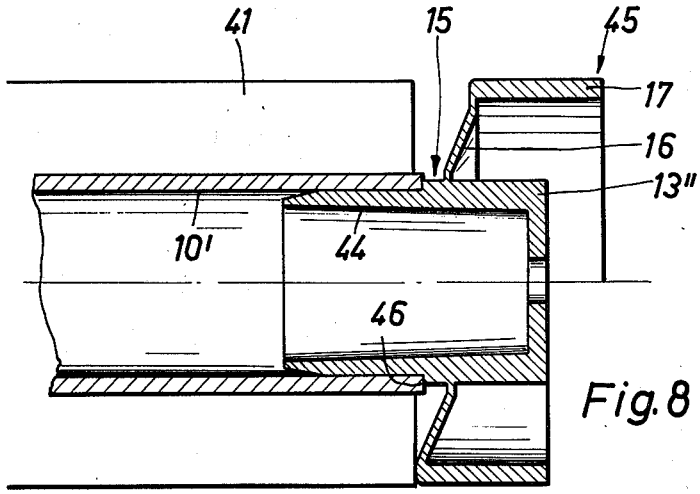
FIGS. 8 to 12 show bobbins provided with snap rings of different form each provided on a plug-in coupling cylinder.

The thread retainer 45 which is shown in FIG. 8 and which is provided with a reflexive snap ring 16 includes a coupling cylinder 44 which is adapted to be fitted to the bobbin sleeve 10'. The connection may be effected by clamps or clips or by a screw connection in order to facilitate replacement of the thread retainer if for example one wishes to use a longer bobbin. The coupling cylinder 44 is a push-fit from one end of the bobbin and is of reduced outside diameter up to the beginning of the thread-receiving channel 15, so that a push-fit limit stop 46 is formed which abuts against the end face of the bobbin sleeve 10'. In the lower half of FIG. 4 the thread clamping position of the snap ring 16 is shown in which the thread-receiving channel 15 is outwardly closed or narrowed to a small clamping gap by the positioning of the snap ring 16 and of the hand-grip 17 in contact with or close to the wound package 41.

Figure 10:
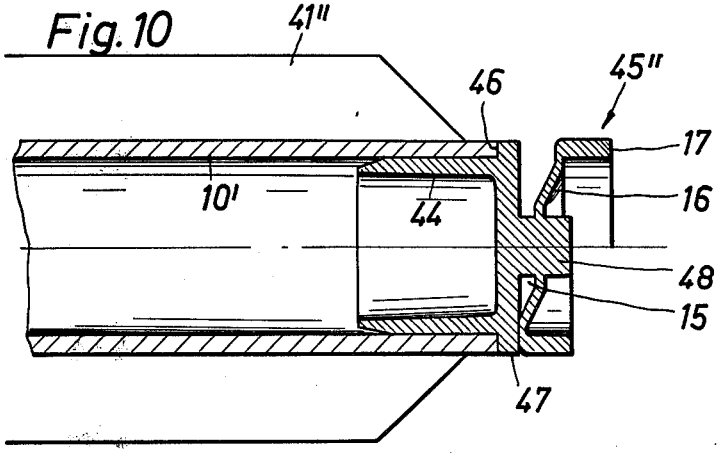
Figure 11:
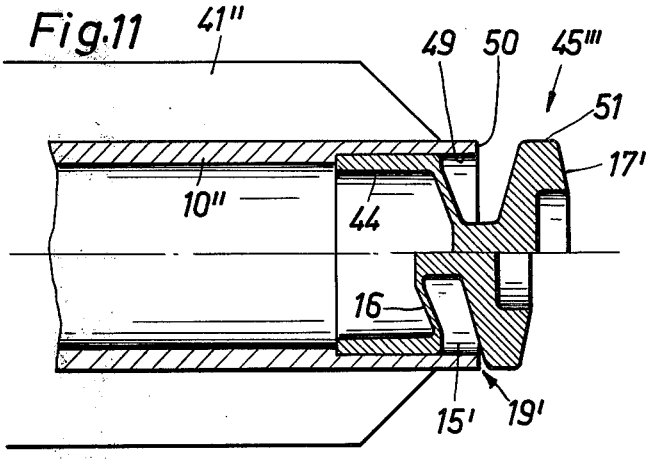

For the use of the thread retainers 40 and 45 of FIGS. 7 and 8 it is necessary that the package 41 should itself be inherently stable and thus not liable to slip sideways. This is achieved for example by a cross-wound package, or with packages 41'' having tapered ends as is shown in FIGS. 10 and 11 In all cases cylindrical bobbin sleeves 10' can be formed into bobbins by push-fit attachment of a thread retainer 40 or 45 to hold fast a thread end for a package without any change being necessary to the bobbon sleeve itself. This therefore overcomes various disadvantageous measures which have been used in the past for holding a thread end fast, such as for example by the angled cutting away from the bobbin.

Figure 9:
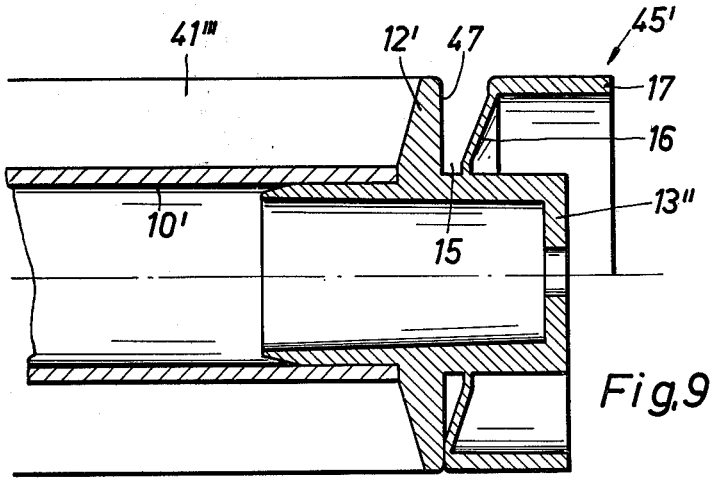

The thread retainer 45' shown in FIG. 9 makes it possible to use an unaltered cylindrical bobbin sleeve 10' even with a package 41''' which is not inherently stable at its ends, for example in the case of a parallel wound package. In this case the thread retainer 45' includes a flange 12' which supports and limits lateral movement of the wound thread 41'''. The thread-receiving channel 15 is defined by the axial end face 47 of the flange 12' and by the snap ring 16 and its sleeve-like hand-grip 17.

The thread retainer 45'' in FIG. 10 is likewise provided with a coupling cylinder 44 which is adapted to be pushed into the bobbin sleeve 10' and which for this purpose is provided with a push-fit limit stop 46.

The thread retainer 45'' includes a central axially outwardly directed stub extension 48 which in comparison with the other extension pieces 13, 13', 13'' has only a relatively small outside diameter, so that the outside diameter of the hand-grip portion 17 which is fixed to the stub by the snap ring 16 does not exceed the outside diameter of the bobbin sleeve 10'. A circumferential stop flange 47 together with the snap ring 16 define the thread-receiving channel 15, as is indicated in the lower half of FIG. 10.

In the embodiment shown in FIG. 11 the hollow bobbin sleeve 10'' is provided with a larger diameter counterbore 49 into which the coupling cylinder 44 of the thread retainer 45''' can be pushed until it strikes the abutment at the bottom of the counterbore. The thread retainer 45''' here includes a hand-grip 17' which is connected to the coupling cylinder 44 by way of the reflexive snap ring 16. The hand-grip 17', the snap ring 16 and the outer end of the bobbin sleeve 10'' together define a thread-receiving channel 15' of large size, the gap 19' of which constitutes a thread clamping zone and is defined by the axial end face 50 of the bobbin sleeve 10'' and by the hand-grip 17', the outsie diameter 51 of which does not exceed that of the bobbin sleeve 10''. Consequently, it is possible, as also in the case of the bobbin shown in FIG. 10, to effect overhead withdrawal of thread from the bobbin without the withdrawal of the thread being hindered by the thread retainer.

Figure 12:
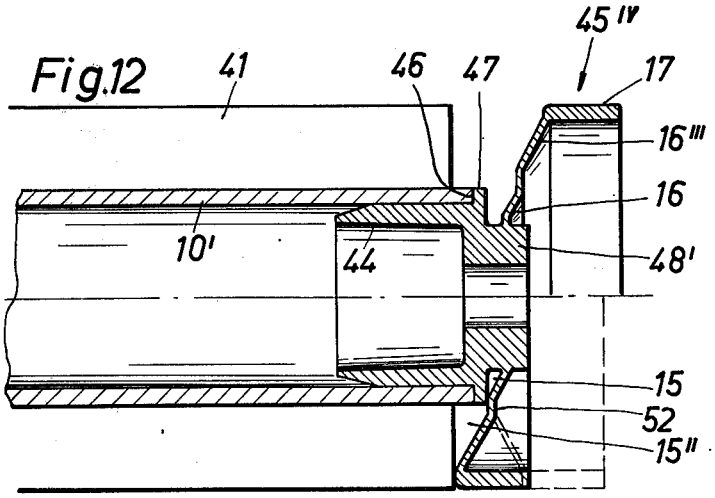

In the modified arrangement shown in FIG. 12 the thread retainer 45$^{IV}$ has a stub extension 48' carrying a first snap ring portion 16 which with the opposed flange 47 defines a first thread-receiving channel 15 in which for example the beginning of a thread to be wound as the package 41 may be held or located. A further snap ring portion 16''' is provided radially outwardly of the first snap ring portion 16 with a intermediate linking piece 52 therebetween. With the aid of the outer snap ring portion 16''' and of the thread-receiving channel 15'' defined by it and by the end of the package 41 itself the thread end of the package 41 can be held fast for example. The holding fast of the threads takes place when the snap ring portions 16 and 16''' are reflexed into the thread clamping positions which are shown in the lower half of FIG. 12. The thread retainer 45$^{IV}$ is so constructed that the snap ring portions 16 and 16''' can be reflexed either inwardly or outwardly independntly of one another.

Figure 13:
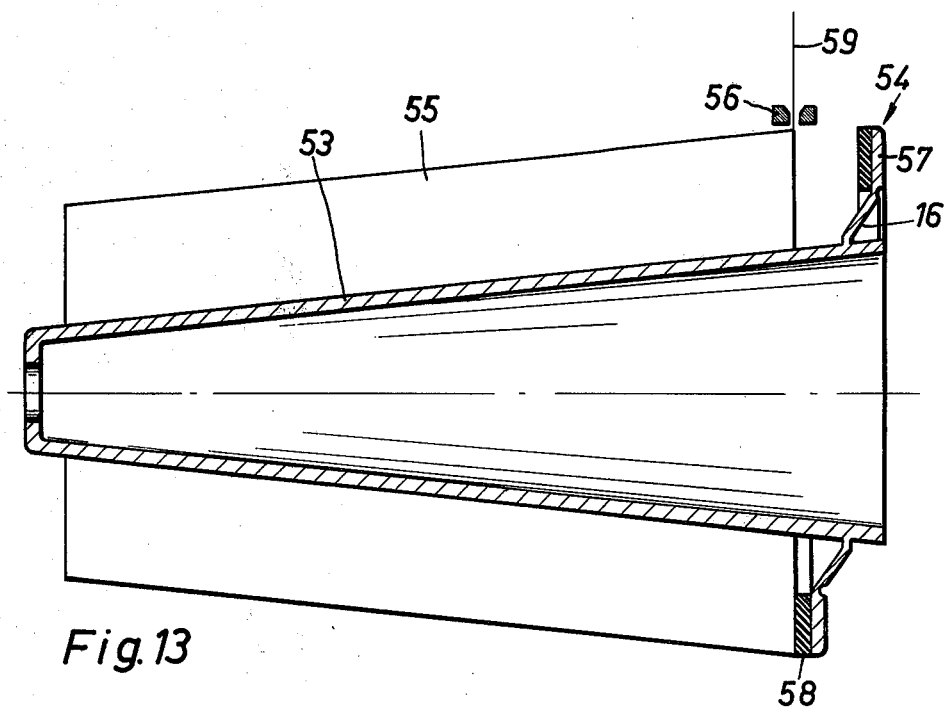
FIG. 13 shows a tapered bobbin with a snap ring provided at the end of the bobbin which is of larger diameter.
Figure 14:
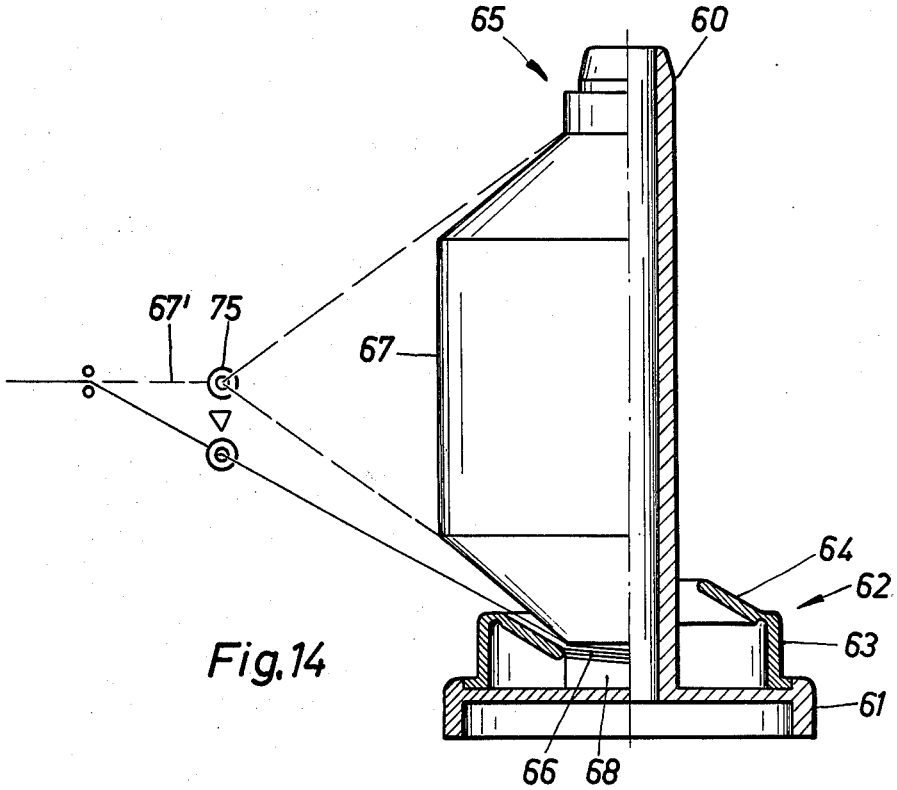
FIG. 14 shows a bobbin formed as a spool holder and having a reflexive snap ring; and, FIGS. 15 and 16 show a side view and a sectional view respectively of a bobbin of short axial length having two flange discs.

In FIG. 13 there is shown a tapering bobbin 53 which has an integral thread retainer 54 at its larger diameter end. The package 55 wound on the bobbin by a thread guide 56 is a tapered package corresponding to the angle of taper of the bobbin 53. The thread guide 54 does not hinder the action of the thread guide when the package is being wound and when the thread guide is in its open position as shown in the upper half of FIG. 9. In this position the snap ring 16 holds a support ring 57, which is used additionally as a hand-grip, away from the package 55. After the movement of the snap ring 16 into the clamping position shown in the lower half of FIG. 13, the support ring 57 which includes an annular lining 58 presses this lining against the end of the package 55 and clamps the thread 59. The thread retainer 54 thus serves additionally as a package protector after the winding of the package has been completed and can accordingly replace conventional bobbins which have a foot plate The bobbin shown in FIG. 14 is formed as a spool holder provided with a bobbin pin 60 and a base 61. The thread retainer 62 is secured to the base 61 by means of a flange ring 63 and has a reflexive snap ring 64 at the free end of the flange ring 63. If the spool 65 shown in the left-hand half of FIG. 14 is fitted on to the bobbin pin 60, this will reflex the snap ring 64 downwards and inwards and the free initially wound turns 66 of the package 67 of the spool will be clamped fast against the sleeve body 68 by the snap ring.

The thread 67' of the package 67 is withdrawn as shown, and remains clamped by the snap ring 64 after the withdrawal of the whole package, so that because of the consequent increase in thread tension one can arrange that the braiding machine is switched off by a switch member 75 in reliable manner.

FIGS. 15 and 16 show a bobbin 70 of short axial length and of small diameter and which has an annular projection 71 positioned centrally of the axial length of the bobbin and extending around its circumference. Two flange discs 72 are fixed to the bobbin core 70 by respective snap rings 16. The flange discs 72 each have a reflexive snap ring $16^{IV}$ at their outer periphery. If the snap rings are reflexed outwards, then one has the position as shown in the left-hand half of FIG. 16 in which the bobbin is ready to be wound. First, the beginning of the thread is inserted into one of the chambers or channels between the inner snap rings 16 and the annular projection 71. Then, the snap rings 16 are reflexed inwards and the inserted thread end is clamped against one are both flange discs 72; the package 72 is then wound spirally between the flange discs. Finally, the thread end 74 is clamped by the other snap rings $16^{IV}$ being reflexed into their clamping positions as shown in the right-hand half of FIG. 16. The thread and the wound package is held and supported without difficulty and can at any time be withdrawn, if necessary after snapping back the outer snap rings $16^{IV}$. In order that the contents of the bobbin can be examined, the flange discs 72 are either made of a transparent material or are provided with windows 76.

It should be understood that the bobbin of the present invention with its reflexive snap rings is suitable for stripform material as well as for thread-form material. It is thus suitable not only for threads, such as yarn, filaments, fibres and wire, but also for tapes, belts, strapping and the like.

I claim:

1. A bobbin for a strand, comprising:

an axially elongated axially symmetrical rigid tubular body adapted to define a thread-receiving slot at a location inwardly from an end of said body;

a generally frustonconical snap ring connected to said body between said location and said end by a first flexible hinge formed unitarily with said body and with said snap ring but having a lesser thickness than said snap ring;

a rigid generally cylindrical sleeve coaxial with said body and spacedly surrounding same while being dimensioned to be received between said locoation and said end; and a second flexible hinge formed unitarily with said snap ring and said sleeve but having a lesser thickness than said snap ring, said hinges and said snap ring being dimensioned to be displacable between a first position wherein an axial end of said sleeve clamps a strand in said slot at said location and a second position wherein said end of said sleeve is spaced from said location to permit insertion and withdrawal of said strand into and out of said slot, the snap ring being displaced between said positions through a deadcenter position by snap action.

2. The bobbin defined in claim 1 wherein said body, said snap ring and said hinges are all formed of thermoplastic material.

3. The bobbin defined in claim 1 wherein said body is formed unitarily with an outwardly extending flange at said location, said flange partly defining said slot and said strand being clamped against said flange by said sleeve.

4. The bobbin defined in claim 1 wherein an opposite axial end of said sleeve and said end of said body lie in a common plane perpendicular to the longitudinal axis of the bobbin when said snap ring is in said first position.

5. The bobbin defined in claim 1 wherein said body is of reduced diameter between said end and said location and is formed with a shoulder at said location, said shoulder having a larger diameter than the internal diameter of said sleeve whereby said sleeve clamps said strand against said shoulder in said first position.

6. The bobbin defined in claim 1 wherein a package of thread is adapted to be wound said body, said package terminating at said location, said strand being clamped against said package in said first position.

7. The bobbin defined in claim 1 wherein said snap ring has two frustoconical portions selectively and separately displaceable between deadcenter positions hingedly connected together.

8. The bobbin defined in claim 1 wherein said body is adapted to be fitted into a core carrying a yarn package.

* * * * *